US010762883B2

(12) United States Patent
Gunn et al.

(10) Patent No.: US 10,762,883 B2
(45) Date of Patent: Sep. 1, 2020

(54) DRUMSTICK

(71) Applicants: BRIGHT IDEAS GLOBAL GROUP LIMITED, Leicestershire (GB); Robert Nigel Witten, Leicestershire (GB)

(72) Inventors: Jeffrey Matthew Titchener Gunn, Leicestershire (GB); Robert Nigel Witten, Leicestershire (GB)

(73) Assignee: BRIGHT IDEAS GLOBAL GROUP LIMITED, Leicestershire (GB)

( * ) Notice: Subject to any disclaimer, the term of this patent is extended or adjusted under 35 U.S.C. 154(b) by 0 days.

(21) Appl. No.: 16/539,148

(22) Filed: Aug. 13, 2019

(65) Prior Publication Data

US 2020/0058275 A1 Feb. 20, 2020

(30) Foreign Application Priority Data

Aug. 17, 2018 (GB) ..... 1813470.0

(51) Int. Cl.
*G10D 13/12* (2020.01)
*F21V 33/00* (2006.01)
*F21Y 115/10* (2016.01)

(52) U.S. Cl.
CPC ..... *G10D 13/12* (2020.02); *F21V 33/0056* (2013.01); *F21Y 2115/10* (2016.08)

(58) Field of Classification Search
CPC ..... G10D 13/12
See application file for complete search history.

(56) References Cited

U.S. PATENT DOCUMENTS 4,106,079 A * 8/1978 Drury ..... G10D 13/12 362/34
4,202,241 A * 5/1980 Lucas ..... G10D 13/12 84/422.4
4,226,163 A * 10/1980 Welcomer ..... G10D 13/12 84/422.4
4,385,544 A * 5/1983 Heiskell ..... G10D 13/12 84/422.4
4,722,035 A * 1/1988 Rapisarda ..... G10D 13/12 362/109
5,280,743 A * 1/1994 Abel ..... G10D 13/12 84/422.4
5,503,056 A * 4/1996 Evans ..... G10D 13/12 84/422.4

(Continued)

FOREIGN PATENT DOCUMENTS

CN 203276813 U 11/2013
GB 2514335 A 11/2014

OTHER PUBLICATIONS

United Kingdom Intellectual Property Office Combined Search and Examination Report dated Oct. 10, 2013, pp. 1-7, United Kingdom.

(Continued)

*Primary Examiner* — Robert W Horn
(74) *Attorney, Agent, or Firm* — Sherman IP LLP; Kenneth L. Sherman; Steven Laut

(57) ABSTRACT

A drumstick including a first portion having a tip for striking a percussion instrument and a second portion separate from and mounted to the first portion. The second portion defines a space to house one or more functional components of the drumstick, and the second portion includes a substantially tubular outer wall defining the space therein.

16 Claims, 6 Drawing Sheets

(56) References Cited

U.S. PATENT DOCUMENTS

| | | | | |
|---|---|---|---|---|
| 6,310,278 | B1 * | 10/2001 | Butler | G10D 13/12 84/422.4 |
| 6,423,891 | B1 * | 7/2002 | Zengerle | G10D 13/12 84/422.4 |
| 6,759,583 | B2 * | 7/2004 | Mizuno | G10D 13/12 84/422.4 |
| 7,176,369 | B1 * | 2/2007 | Brooks | G10D 13/12 84/422.4 |
| 7,595,442 | B2 * | 9/2009 | Grover | G10D 13/12 84/422.4 |
| 7,687,700 | B1 * | 3/2010 | Torres | G10D 13/12 84/422.4 |
| 7,855,332 | B1 * | 12/2010 | Turos | G10D 13/12 84/422.4 |
| 7,868,237 | B1 * | 1/2011 | Quilon | G10D 13/12 84/422.4 |
| 8,168,875 | B2 * | 5/2012 | Stockli | G10D 13/12 84/422.4 |
| 8,389,842 | B2 * | 3/2013 | Alleyne | B25G 1/102 84/422.4 |
| 9,082,313 | B1 * | 7/2015 | McCarthy | G09B 15/023 |
| 9,111,512 | B2 * | 8/2015 | Richards | G10D 13/12 |
| 9,117,427 | B2 * | 8/2015 | Piccionelli | G10D 13/12 |
| 9,123,268 | B2 * | 9/2015 | Uehara | G10H 1/053 |
| 9,430,997 | B2 * | 8/2016 | Hardi | G10H 1/18 |
| 10,482,854 | B1 * | 11/2019 | Freer | G10D 13/12 |
| 2004/0231493 | A1 * | 11/2004 | Milne | G10D 13/12 84/422.4 |
| 2006/0027073 | A1 * | 2/2006 | Richard | G10D 13/12 84/422.4 |
| 2006/0056167 | A1 * | 3/2006 | Weigl, Jr. | A47G 21/02 362/34 |
| 2020/0058275 | A1 * | 2/2020 | Gunn | G10D 13/12 |

OTHER PUBLICATIONS

United Kingdom Intellectual Property Office Examination Report dated Feb. 7, 2019, pp. 1-3, United Kingdom.

* cited by examiner

DRUMSTICK

BACKGROUND

The present teachings related to a drumstick.

Typically drumsticks are manufactured from wood and are produced with a number of design variations to achieve a desired sound, balance and longevity, as well as being adapted to different users and their playing styles.

Thinner and lighter sticks typically allow faster playing and create a lighter sound on percussion instruments such as drums and cymbals. Thicker and heavier sticks will provide more power and projection but cannot be played as quickly.

The overall length of a drumstick as well as its tapering towards the tip also affects the "feel" of the stick and the subject of a particular user preference.

It is also known to make drumsticks from materials other than wood, such as metal or plastics.

Further, it is known to incorporate functional components into drumsticks such as LEDs (light emitting diodes) in order that some or all of the drumstick can be lit. This may be desirable as it allows a drummer, who is typically located towards the rear of a stage, and is often hidden behind their drum kit, to have a greater visibility as part of an overall performance.

However, problems exist in incorporating components such as LEDs and batteries required to power said LEDs into a drumstick, whilst maintaining the playability and feel of that drumstick.

SUMMARY

A first aspect provides a drumstick comprising a first portion having a tip for striking a percussion instrument and a second portion separate from and mounted to the first portion. The second portion defines a space to house one or more functional components of the drumstick, and the second portion comprises a substantially tubular outer wall defining the space therein. The drumstick further comprises a cap arranged to close the space on an end remote from the tip. The first portion comprises an extension, which extends at least partially within the space, and the cap is arranged to be secured to the extension.

By providing the second portion as a tube, the space therein can be maximised. This may allow the drumstick to be thinner. Further, the length of the drumstick can be customised, e.g. for adult vs child users or different styles of drumming without significant additional tooling costs. Finally, it may enable the 'balance' of the drumstick to be optimised, such that the feel of a drumstick with additional functions to be tuned to be similar to that of a conventional drumstick.

A cap provides a convenient way of closing the space from foreign matter.

This arrangement effectively allows the second portion to be clamped in place between the first portion and end cap.

The drumstick may further comprise a light source, such as a Light Emitting Diode (LED), arranged such that light is selectively emitted at least from the tip of the device.

The emission of light from a drumstick is a desirable feature as it enables a drummer, who is often less visible during a performance, to have a greater visual impact.

The light source may be housed within the space.

The light source is a functional component that may conveniently be housed within the space.

The drumstick may further comprise a light guide which is provided through first portion such that light from the light source may reach the tip.

The entirety of the first portion may be substantially formed from light transmissive material, such as polycarbonate.

This simplifies manufacture of the drumstick, and further may allow light to be emitted at other locations within the first portion.

The drumstick may further comprise an energy storage device, such as a battery or capacitor, housed within the space.

The tubular wall arrangement maximises the available space for energy storage, especially if button or cylindrical cells are used.

The drumstick may further comprise an accelerometer, gyroscope and/or inertial switch housed within the space.

An accelerometer or switch may be used to sense striking or other movement of the drumstick to assist in providing additional functions, e.g. if coupled with a light source to permit the light source to be triggered upon impact with an instrument.

The drumstick may further comprise a printed circuit board (PCB) housed within the space.

A PCB further facilitates additional functions of the drumstick.

The energy storage device may be mounted to the printed circuit board.

This further integrates multiple functional components to make the drumstick more compact and potentially ease assembly thereof.

The cap may further comprise a user input, such as a switch, to control operation of the drumstick.

The cap is at a convenient location to mount a switch where it is accessible but less susceptible to damage.

The cap may further comprise an interface for enabling charging of the energy storage device.

The cap is a convenient location to mount an interface for charging where it is accessible but less susceptible to damage.

The extension may comprise a boss extending in a transverse direction for fixing of the cap thereto.

A boss provides material to enable, for example, a female thread to be cut into the extension for a threaded fastener to mount the cap thereto.

The drumstick may further comprise a printed circuit board (PCB) and the boss may further locate the PCB.

This arrangement may further facilitate assembly of the drumstick.

The drumstick may further comprise a resilient element, such as an O-ring, which is provided between the first and second portions.

A resilient element may dampen vibrations that are generated at the tip, so the vibrations transmitted to the second portion are reduced. This may make the drumming more comfortable. Further the resilient element may seal the space to inhibit foreign material entering the space and harming function of the drumstick.

A second aspect provides a method of assembling a drumstick of the first aspect, the method comprising the steps of:

a. mounting the second portion to the first portion;
b. providing at least one functional component in the space prior or subsequent to step a.; and
c. securing the cap to the extension of the first portion so as to secure the first and second components together.

The method may comprise a further step d., prior to step a., of injection moulding the first portion.

BRIEF DESCRIPTION OF THE DRAWINGS

Embodiments of the teachings are now described, by way of example only, with reference to the accompanying drawings in which.

DETAILED DESCRIPTION

Figure 1:
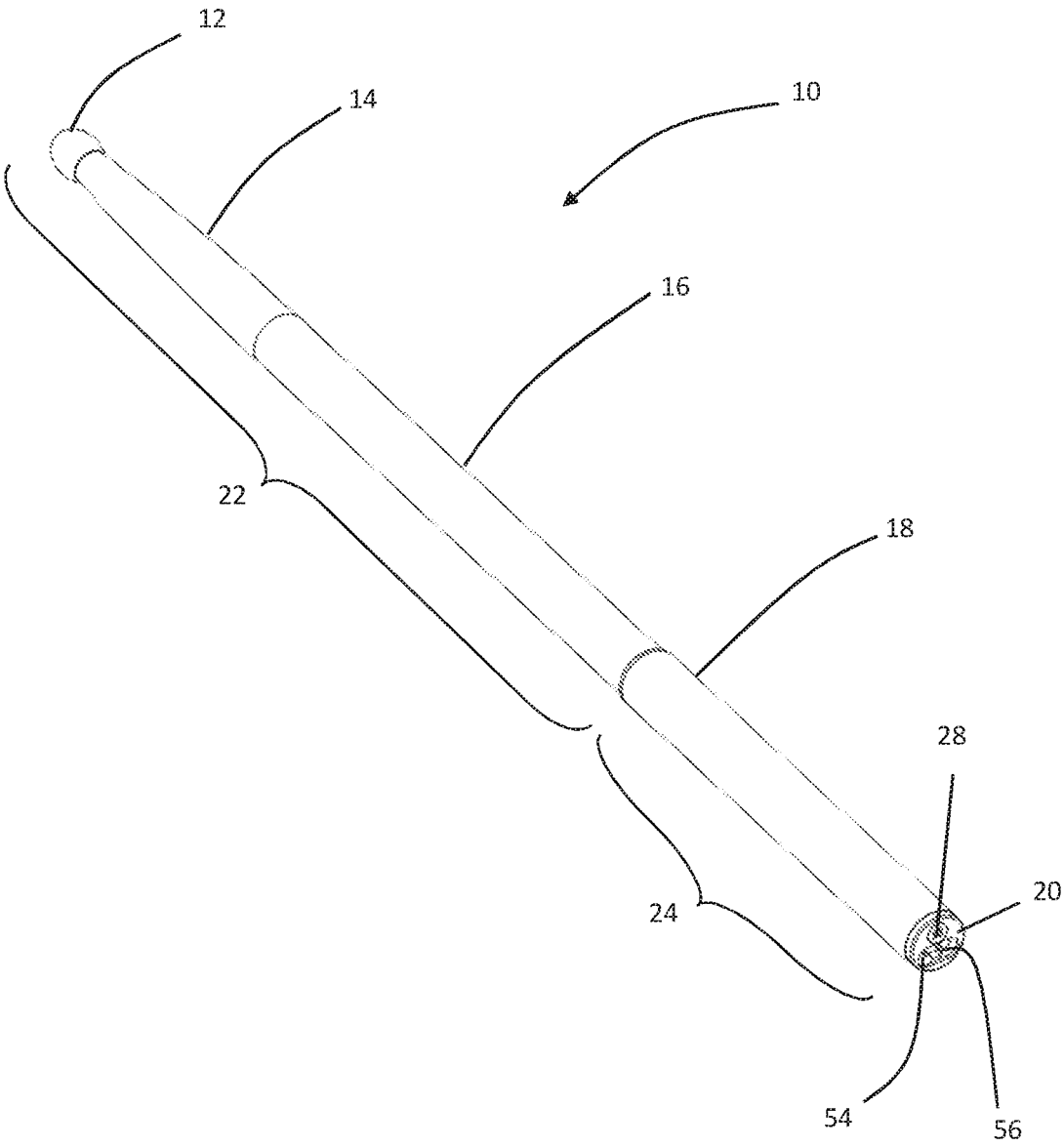
FIG. 1 is an isometric view of a drumstick in accordance with the teachings.

With reference to FIG. 1 a drumstick in accordance with the present teachings is generally indicated at 10. The drumstick comprises multiple parts along its length, specifically a tip 12 that is rounded and intended to contact a drum or other instrument to cause that instrument to generate noise, a taper 14, a substantially cylindrical shaft 16 and a substantially cylindrical handle 18. The drumstick 10 terminates at the end remote from the tip 12 in an end cap 20 as discussed in more detail below.

In this embodiment, the tip 12, taper 14 and shaft 16 are all integrally and monolithically formed from the same piece of material. Typically, this is achieved in an injection moulding process as discussed in more detail below. In other embodiments, this may not be the case, e.g. the tip 12 may be separately attachable onto the taper. In addition, in other embodiments, no cylindrical shaft may be provided, e.g. the handle may interface with the taper. Further, in this embodiment the tip 12, taper 14, and shaft 16 are formed from a transparent polycarbonate material, although in other embodiments may be formed from wood or other plastics material, for example.

Figure 7:
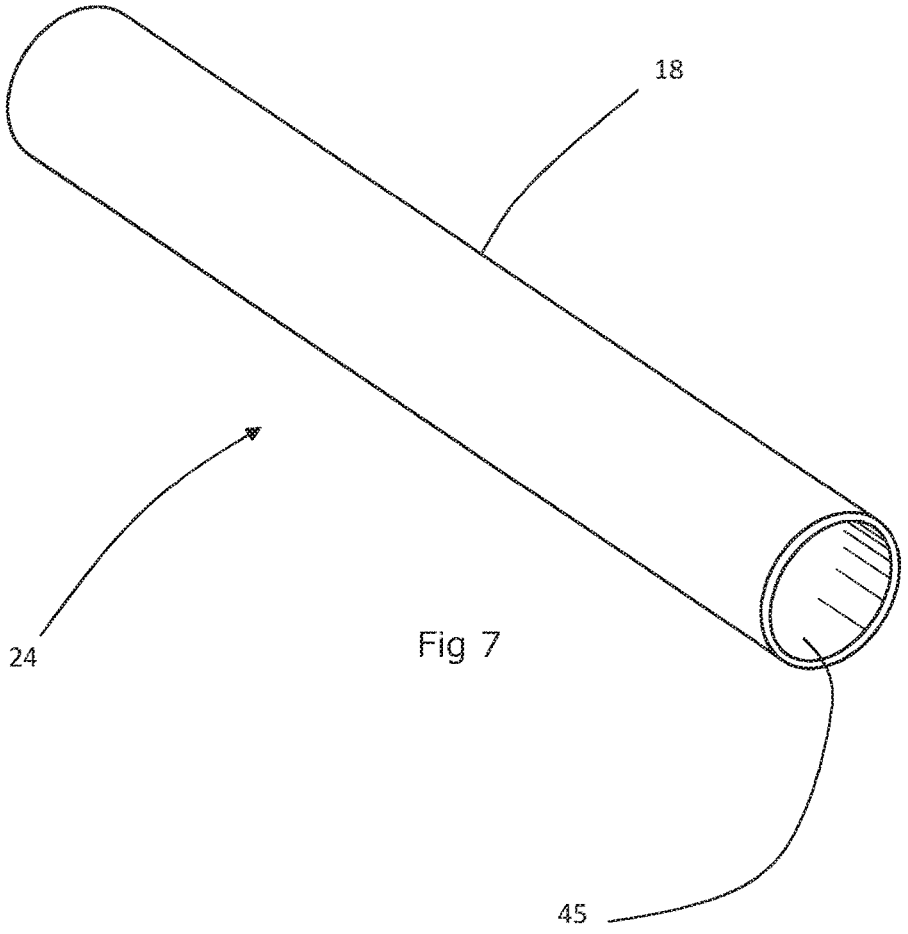
FIG. 7 is an isometric view of a further portion of the drumstick of FIG. 1.

With reference to FIG. 7, the handle 18 is formed in this embodiment from a tube of the same or a similar diameter to that of the shaft 16, but defining a hollow space therein, as described in more detail below. In this embodiment the tube is aluminium. In other embodiments, the handle 18 may be formed from other materials such as other metals, plastics such as nylon or polycarbonate or composite materials such as carbon fibre and resin, the tubular shape may be formed by extrusion, deep drawing or bending of a flat sheet of material, for example.

Finally, the end cap may also be made of a plastics material, as in this embodiment, or a suitable metal, e.g. aluminium.

In this embodiment, the tip 12, taper 14 and shaft 16 define a first portion 22 and the handle 18 defines a second portion 24.

Figure 2:
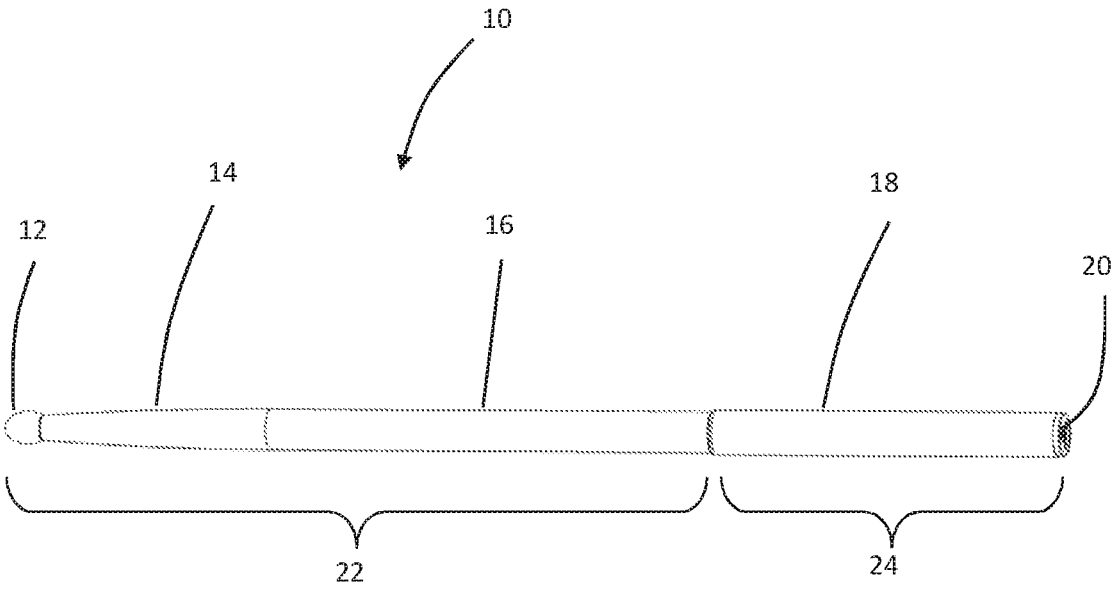
FIG. 2 is a side view of the drumstick of FIG. 1.
Figure 3:
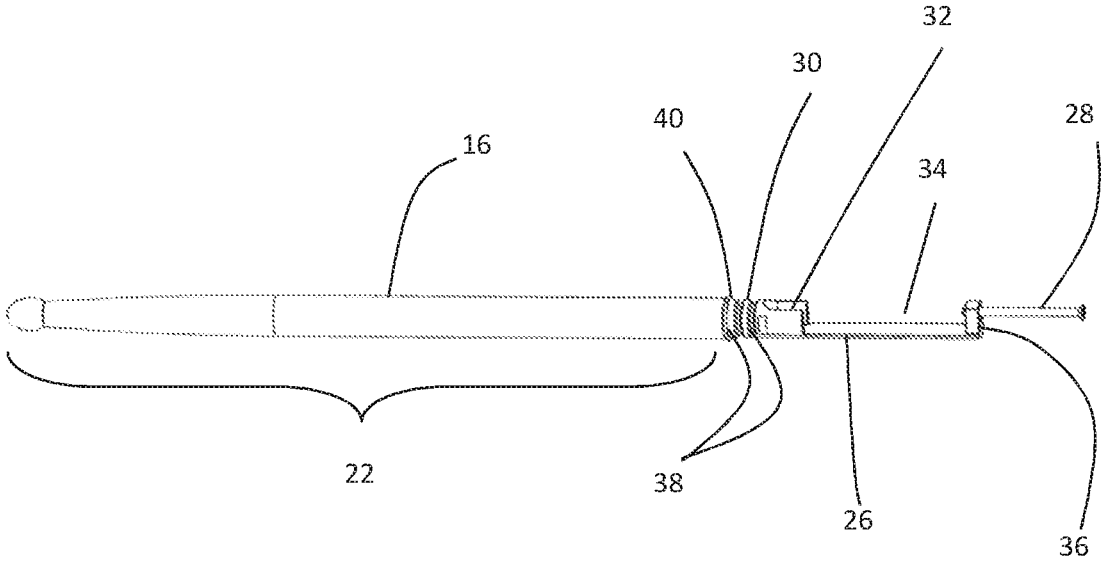
FIG. 3 is a partially dismantled view of the drumstick of FIG. 1.

Referring now to FIGS. 3 to 6, the drumstick 10 is shown in various states of assembly. In FIG. 3 the first portion 22 is visible, together with an extension thereof 26 which is received within the handle 18 and is therefore not visible in FIGS. 1 and 2. In addition, a screw 28 is depicted that is mounted to the extension 26. The extension 26 is also integrally and monolithically formed with the first portion 22, e.g. by injection moulding. As can be seen from FIGS. 3, 4 and 5 the extension comprises the following sections, starting from its connection to the shaft 16: a mounting portion 30, a light housing 32, a support 34 and a boss 36.

The mounting section 30 is dimensioned to receive and support the handle 18 and in this embodiment includes two annular recesses 38 that are arranged to receive O-rings (not shown) and therefore both damp and seal the handle 18 to the first portion 22. The mounting section 30 also includes a stop 40 that in this embodiment is an area of increased diameter with respect to the shaft 16 in order to prevent the handle 18 from sliding any further down the first portion 22. In other embodiments the stop may simply be an annular end face of the shaft 16 such that the handle 18 and the shaft 16 are of the same overall diameter.

The light housing 32 is a depression in the generally cylindrical body of the first portion 22 that is open on one radial face, and closed on two sides. An axial end wall 42 is provided at the end facing the first portion 22 and is rounded so as to receive the light emitting portion of an LED 44 (shown in phantom in FIG. 6). When the LED 44 is lit this enables the light to pass axially through the shaft 16, taper 14 and be emitted at the tip 12 and along its length. The support 34 is a relatively thin elongate portion that is arranged to sit proximate to an inner surface 45 of the tubular handle 18. As such, the support 34 provides a connection axially to the boss 36 whilst not consuming a significant amount of the space provided within the handle 18.

The boss 36 extends transversely from the support 34 at its end remote from the first portion. The boss 36 is provided with a bore that extends axially, into which the screw 28 may be secured, in particular, the screw 28 may be self-tapping and the bore may act as a form of pilot hole, or a suitable threaded insert (not shown) may be provided in the bore to retain the screw.

Figure 4:
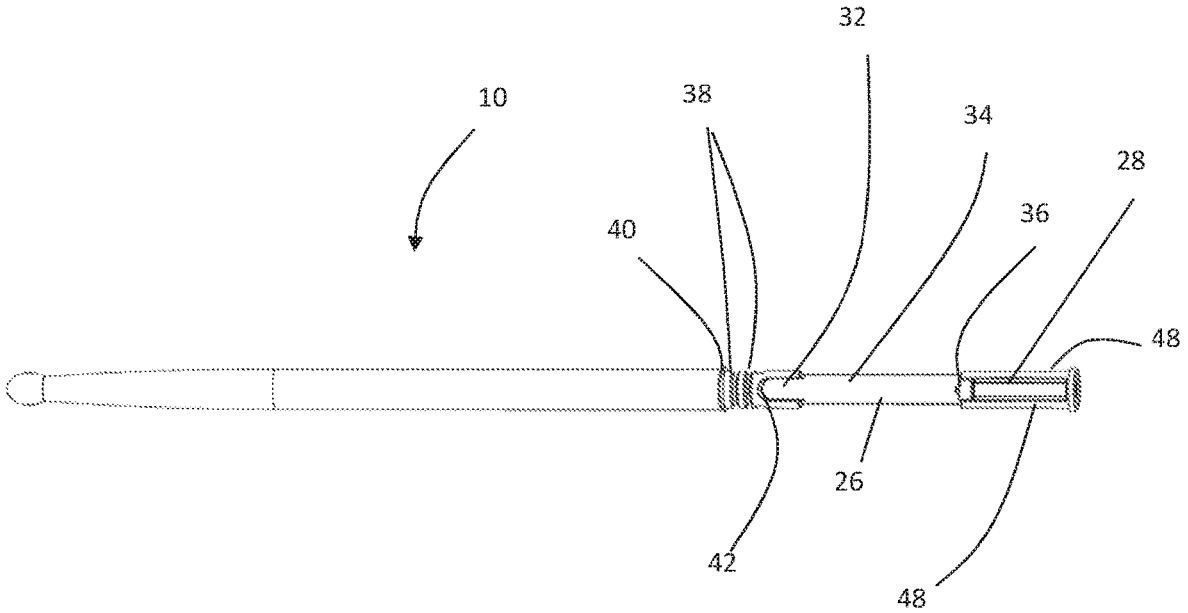
FIG. 4 is a plan view of the drumstick of FIG. 1 in a partially assembled state.
Figure 5:
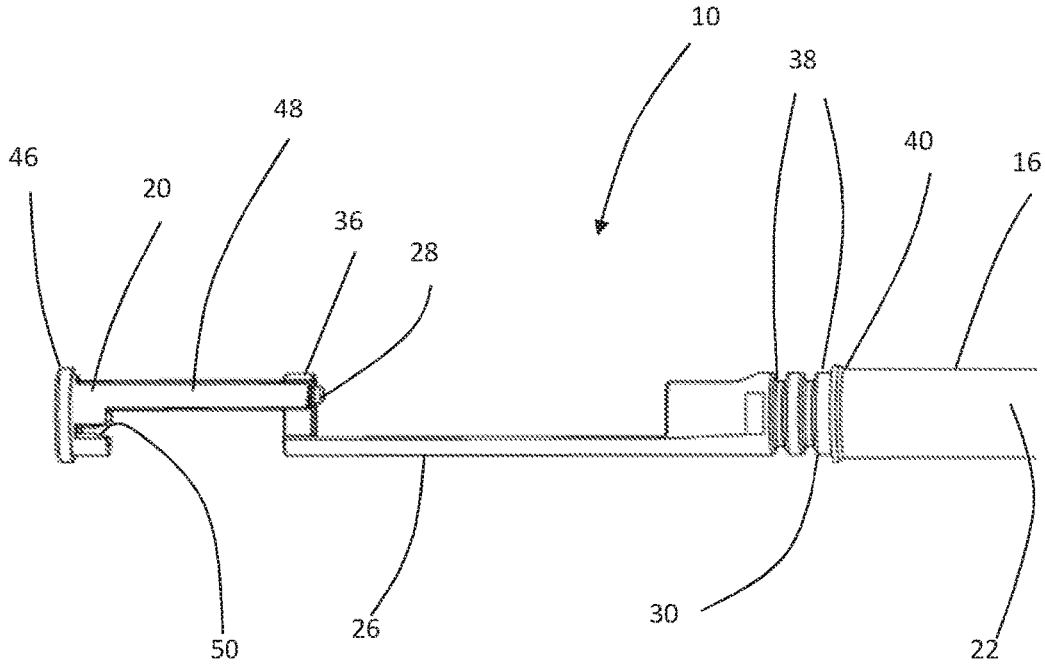
FIG. 5 is an enlarged view of a portion of the drumstick as depicted in FIG. 4 when viewed from the side.
Figure 6:
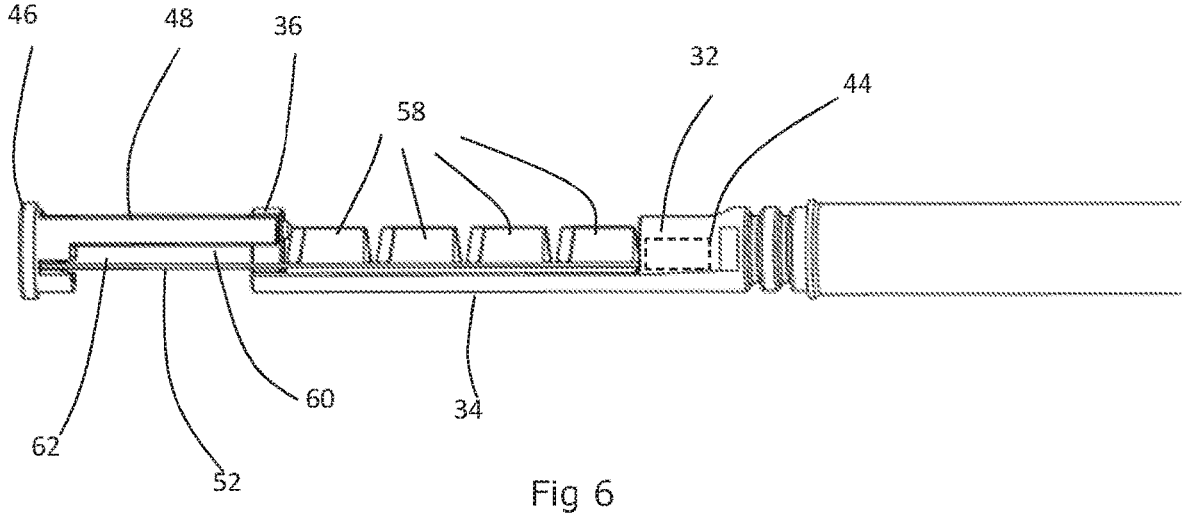
FIG. 6 is a view similar to FIG. 5 but with further functional components of the drumstick assembled therein.

As can most clearly be seen in FIGS. 4, 5 and 6, the screw 28 is utilised to mount the end cap 20 to the extension 26 and therefore to the first portion 22.

The end cap 20 comprises a section 46 that has a diameter substantially the same as that of the handle 18 (and stop 40), which therefore acts to confine the handle 18 between the head section 46 and the stop 40. Two arms 48 extend from the head 46 towards the extension 26 and have curved radially outer profiles which are shaped and dimensional so as to substantially conform to the inner surface 45. This further aids the stability of the drumstick 10 when assembled.

A mouth 50 also is provided in the end cap 20 and, as can be seen from FIG. 6, is arranged to receive a printed circuit board (PCB) 52. As well as supporting the PCB 52 the mouth also has aperture 54 that extends through to the end face. This enables a switch 56 mounted on to the PCB to extend through to the end wall of the end cap 20 where a user can actuate the switch, e.g. to turn the light function on and off.

As shown in the embodiment of FIG. 6, the PCB 52 is also arranged to mount four button cell batteries 58 within the space adjacent to the support 34, as well as the LED 44 using suitable mounts or "cages" 59. However, in alternative embodiments, there may be any suitable number of cell batteries. It will be appreciated that a hole is provided in the PCB 52 in order that it may fit over the boss 36. This further assists in the axial retention of the PCB 52. In addition, as shown in FIG. 6 a controller 60, e.g. a microprocessor controller, is mounted to the PCB in the space adjacent to the arms 48. Further, this space is also used to mount an inertial switch 62.

In other embodiments this space, as well as the space adjacent to the support 34 may be used to additionally or alternatively mount other functional components such as accelerometers, gyroscopes, capacitors, re-chargeable batteries, motors or actuators to provide haptic feedback, power sockets, communication interfaces, or other functional components. For the embodiment depicted in FIGS. 1 to 6, assembly of the drumstick is achieved as follows:

The first portion 22 is injection moulded and the second portion 24 is manufactured by extrusion, drawing or other suitable method. The batteries 58 are mounted to the PCB 52, which already has the controller 60, an inertial switch 62 and LED 44 mounted thereto (e.g. by soldering). The PCB 52 is then mounted to the extension 26 by the aperture 54 in the PCB being fitted over the boss 36 and the LED 44 being accommodated in the light housing 32. The O-rings are then fitted into the annular recesses 38 and the handle 18 is slid over the extension 26 until it abuts the stop 40. The end cap 20 is then slid within the space defined by the handle 18 such that the PCB is accommodated within the mouth 50 and the arms 48 are situated adjacent the boss 36.

The screw 28 is then threaded into the boss 36 and tightened. The act of tightening the screw in effect clamps the axial ends of the handle 18 between the stop 40 and the head section 46. This stabilises the handle 18 on the first portion 22 so that relative movement between the first portion 22 and the second portion 24 is minimised. However, at the same time the O-rings (not shown) within the recesses 38 act to dampen the transmission of vibrations from the tip 12 through to the handle 18 when the drumstick 10 strikes a suitable percussion instrument. To use the drumstick 10, a drummer firstly turns on the lighting function by pressing switch 56. In a typical mode of operation, the inertial switch 62 is arranged such that when the drumstick 10 impacts a drum or other instrument this closes the circuit connecting the cells 58 to the LED 44 and causes the LED to become illuminated and emit the light through the first portion 22 and be emitted at the tip 12 and along the first portion 22.

However, in more advanced versions of the drumstick 10 the controller 60 may control the colour of the light emitted by the LED, the duration of lighting, whether the lighting is continuous or flashing, for example.

Further, in other variants the switch 56 may be operable to switch the drumstick 10 to operate in different modes, e.g. continuous lighting in a single colour or cycling through colours, for example. In a further variant, the inertial switch may be replaced by an accelerometer or gyroscope to provide more precise inputs to the controller 60 of the drumstick's 10 orientation or position in space. This may be utilised to further control how the light is emitted from the drumstick 10.

In still further variants, the cells 58 may be replaced by a re-chargeable battery and a suitable charging interface may be provided on the end face of the end cap 20 to enable the re-chargeable battery to be charged. A suitable interface may be a micro USB or USB-C type connector.

With reference in particular to FIGS. 5 and 6, it will be appreciated that various lengths of handle 18 can inherently be mounted to the first portion simply by using the screw 28 to adjust the position of the head section 46 relative to the stop. As such the shortest length of handle to be mounted would be that of a length where the mouth 50 of the end cap 20 abuts against the boss 36. Conversely, longer screws and end caps with longer arms 48 may be utilised to allow for a longer handle 18 without needing to change the mould tool used to mould the first portion 22. This therefore allows the drumstick 10 to be customised to particular user requirements without expensive re-tooling.

Figure 8:
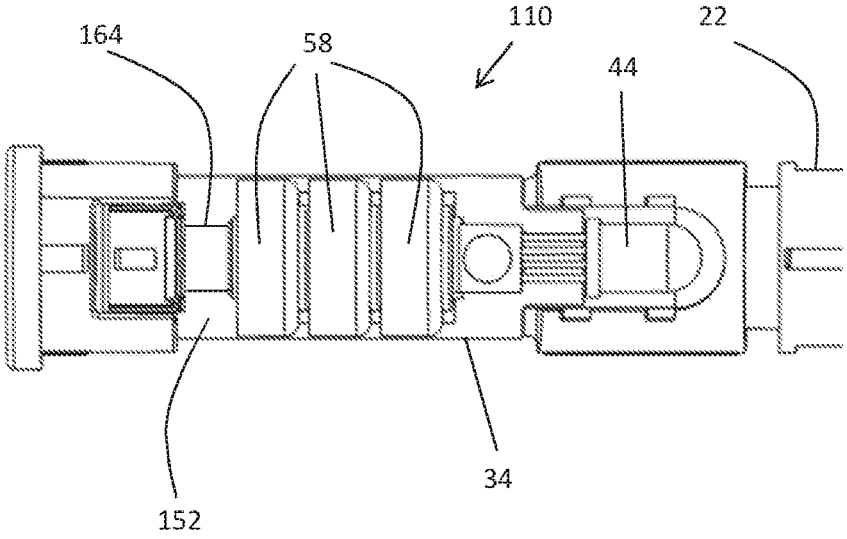
FIG. 8 is an enlarged view of a portion of a drumstick according to another embodiment in a partially assembled state.

Referring now to FIG. 8, a first portion 22 identical to that of the first embodiment is shown in enlarged plan view of the extension 26 thereof. However, in this embodiment the button cell batteries 58 are stacked in series with their planar end faces in contact with each other. The cells 58 are mounted to a smaller PCB 152 via end terminals 164. This arrangement of cells 58 is more compact in an axial direction than the arrangement depicted in FIG. 6, thereby enabling the PCB 152 to be significantly smaller or other functional components to be located in the space adjacent to the support 34.

Figure 9:
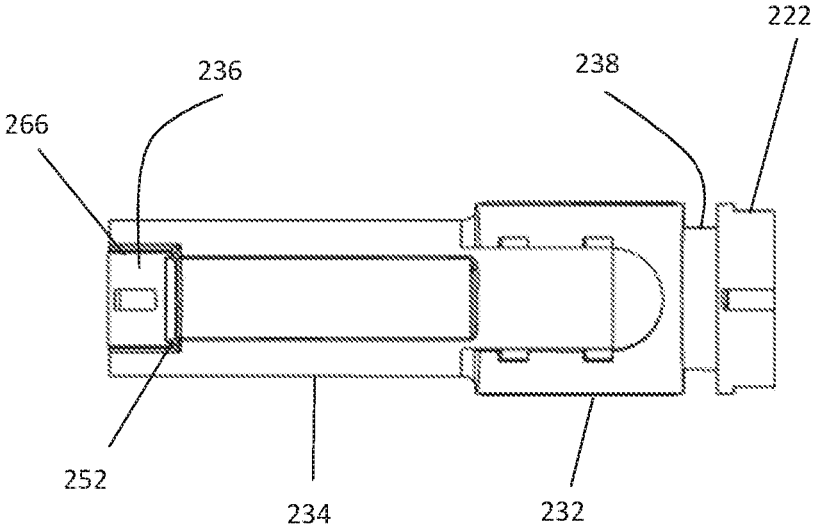
FIG. 9 is a further embodiment of a drumstick in a partially assembled state.

Referring to FIG. 9, like parts from previous figures described herein are denoted with the prefix '2'. FIG. 9 depicts a further alternative embodiment where the first portion 222 has been reconfigured such that the support 234 is shortened and the boss 236 is therefore closer to the light housing 232 than in the first portion 22 of the first embodiment. Again, this allows a smaller PCB 252 to be used and optionally for the PCB to be provided with an aperture 266 to locate it thereon. This arrangement may allow for an even greater customisation of the length of the handle 18 as there is more scope for adjustment of the position of the end cap 20 relative to the boss 236.

Figure 10:
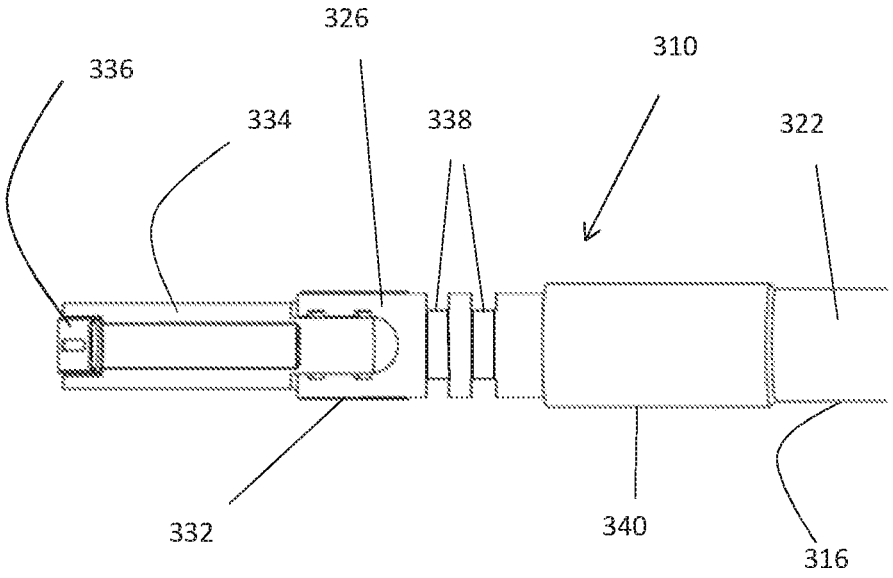
FIG. 10 is a plan view of a further partially assembled drumstick according to another embodiment.

Referring to FIG. 10, like parts from previous figures described herein are denoted with the prefix '3'. FIG. 10 illustrates a still further variant of the first portion 322 where the extension 326 is substantially the same as the extension 226 of FIG. 9 but the shaft 316 has been elongated by the introduction of a stop 340 that is substantially longer axially than that depicted in the first embodiment of FIGS. 1 to 6. As this portion is of a constant cross section, the injection moulding tool for the first portion 322 can be easily reconfigured to change the length of this portion without significant re-tooling costs. This therefore provides a further opportunity for customising the length and/or balance of the drumstick 310 of FIG. 10.

It will be appreciated that numerous changes may be made within the scope of the present teachings. For example, the first portion may be manufactured from wood with a separate clear tip and clear light guide extending through the centre of the wood. Further, the tip may be frosted to alter the light emission. A handle may be formed from different tubular material such as tubular nylon or polycarbonate. The tip may be changed to be one that is mallet shaped or spherical and/or made of softer material. The drumstick may be adapted to become a foot pedal operated drumstick, the polycarbonate material may be dyed to be a different colour, may have UV fluorescent properties or be glow in the dark. The drumstick may additionally be able to output signals via BLUETOOTH® or an interface, e.g. to allow the stick to play "virtual" drums in space and still create a sound via a speaker in conjunction with a suitable accelerometer and/or gyroscope. Further or alternatively the drumstick may incorporate its own sounder within the space of the handle, the drumstick may be configured such that the LED may be used in a particular mode to indicate the charged state of the batteries, e.g. by emitting a green light to indicate that the battery charge is good, amber that it is at an intermediate level, and red to show that the batteries are almost exhausted. Alternative arrangements may be used to secure the first and second portions together, e.g. complimentary threaded connections, bayonet-type fittings and/or adhesive. In further embodiments, the drumstick may be mounted to a foot pedal so as to strike a bass drum upon operation of the foot pedal.

What is claimed is:

1. A drumstick comprising:

a shaft integrated with a taper that includes a tip for striking a percussion instrument; and a handle that is removably coupled to a mounting section of the shaft, the handle defining a space that houses one or more functional components of the drumstick, the handle comprising a substantially tubular outer wall defining the space therein, wherein the drumstick further comprises a removable cap that closes the space on a first end of the handle that is remote from the tip, the shaft further comprises an extension, which extends at least partially within the space, and the cap is arranged to be secured to the extension.

2. The drumstick of claim 1, further comprising a light source, arranged such that light is selectively emitted at least from the tip of the drumstick.

3. The drumstick of claim 2, wherein the light source is housed within the space.

4. The drumstick of claim 3, wherein a light guide is provided through the shaft and the tape such that light from the light source reaches the tip.

5. The drumstick of claim 4, wherein substantially the entirety of the shaft and the taper is formed from light transmissive material.

6. The drumstick of claim 1, further comprising an energy storage device housed within the space.

7. The drumstick of claim 1, further comprising one or more of an accelerometer, gyroscope or an inertial switch housed within the space.

8. The drumstick of claim 1, further comprising a printed circuit board (PCB) housed within the space.

9. The drumstick of claim 8, further comprising an energy storage device housed within the space, wherein the energy storage device is mounted to the printed circuit board.

10. The drumstick of claim 1, wherein the cap further comprises a user input to control operation of the drumstick.

11. The drumstick of claim 1, further comprising an energy storage device housed within the space, wherein the cap further comprises an interface for enabling charging of the energy storage device.

12. The drumstick of claim 1, wherein the extension comprises a boss extending in a transverse direction for fixing of the cap thereto.

13. The drumstick of claim 12, further comprising a printed circuit board (PCB) housed within the space, wherein the boss further locates the PCB.

14. The drumstick of claim 1, wherein a resilient element is disposed between the shaft and the handle.

15. A method of assembling a drumstick according to claim 1, the method comprising:

mounting the handle to the shaft via the mounting section providing at least one functional component in the space; and securing the cap to the extension of the shaft so as to secure the shaft and the handle together.

16. The method of claim 15, further comprising injection moulding the shaft and the taper.

* * * * *